US006931764B2

(12) United States Patent
Swigart et al.

(10) Patent No.: US 6,931,764 B2
(45) Date of Patent: Aug. 23, 2005

(54) FOOTWEAR SOLE STRUCTURE INCORPORATING A CUSHIONING COMPONENT

(75) Inventors: John F. Swigart, Portland, OR (US); Eric S. Schindler, Portland, OR (US)

(73) Assignee: Nike, Inc., Beaverton, OR (US)

( * ) Notice: Subject to any disclaimer, the term of this patent is extended or adjusted under 35 U.S.C. 154(b) by 67 days.

(21) Appl. No.: 10/633,361

(22) Filed: Aug. 4, 2003

(65) Prior Publication Data

US 2005/0028403 A1 Feb. 10, 2005

(51) Int. Cl.[7] ..... A43B 13/20
(52) U.S. Cl. ..... 36/29; 36/35 B
(58) Field of Search ..... 36/29, 35 B, 153; 601/150–152

(56) References Cited

U.S. PATENT DOCUMENTS

| | | | |
|---|---|---|---|
| 900,867 | A | 10/1908 | Miller |
| 1,069,001 | A | 7/1913 | Guy |
| 1,181,441 | A | 5/1916 | Franklin |
| 1,240,153 | A | 9/1917 | Olsen |
| 1,304,915 | A | 5/1919 | Spinney |
| 1,323,610 | A | 12/1919 | Price |
| 1,514,468 | A | 11/1924 | Schopf |
| 1,584,034 | A | 5/1926 | Klotz |
| 1,625,582 | A | 4/1927 | Anderson |
| 1,625,810 | A | 4/1927 | Krichbaum |
| 1,869,257 | A | 7/1932 | Hitzler |
| 1,916,483 | A | 7/1933 | Krichbaum |
| 1,970,803 | A | 8/1934 | Johnson |
| 2,004,906 | A | 6/1935 | Simister |
| 2,080,469 | A | 5/1937 | Gilbert |
| 2,086,389 | A | 7/1937 | Pearson |
| 2,269,342 | A | 1/1942 | Johnson |
| 2,365,807 | A | 12/1944 | Dialynas |

(Continued)

FOREIGN PATENT DOCUMENTS

| | | |
|---|---|---|
| AT | 181938 | 2/1906 |
| AT | 200963 | 12/1958 |
| CA | 727582 | 2/1966 |
| CN | 75100322 | 1/1975 |
| CN | 54221 U | 6/1978 |
| DE | 32 34 086 | 9/1982 |
| DE | 352216 | 4/1992 |
| DE | 92 01 758.4 | 12/1992 |
| EP | 0 094 868 | 5/1983 |
| EP | 0 215 974 A1 | 9/1985 |
| EP | 0 605 485 B1 | 9/1992 |
| FR | 1195549 | 11/1959 |
| FR | 1406610 | 11/1965 |
| FR | 2144464 | 1/1973 |
| FR | 2404413 | 4/1979 |

(Continued)

OTHER PUBLICATIONS

International Search Report in corresponding PCT application, application number PCT/US2004/024884, mailed Nov. 30, 2004.

Sports Research Review, NIKE, Inc., Jan./Feb. 1990.

Brooks Running Catalog, Fall 1991.

Office Action dated Dec. 16, 2004 in U.S. Appl. No. 10/620,837 (attorney docket No. 005127.85919) (13 pages total).

*Primary Examiner*—Ted Kavanaugh
(74) *Attorney, Agent, or Firm*—Banner & Witcoff, Ltd.

(57) ABSTRACT

A cushioning component for an article of footwear is disclosed that includes a fluid-filled chamber and a covering element extending over a portion of the chamber. The chamber is devoid of internal connections, and the fluid within the chamber may be at a pressure that is substantially equal to an ambient pressure. The chamber defines a plurality of lobes, and the cushioning element includes a plurality of inserts that extend between the lobes. The inserts are elongate structures that decrease the compressibility of peripheral portions of the cushioning component.

50 Claims, 13 Drawing Sheets

U.S. PATENT DOCUMENTS 2,488,382 A 11/1949 Davis
2,546,827 A 3/1951 Lavinthal
2,600,239 A 6/1952 Gilbert
2,645,865 A 7/1953 Town
2,677,906 A 5/1954 Reed
2,703,770 A 3/1955 Melzer
2,748,401 A 6/1956 WInstead
2,762,134 A 9/1956 Town
3,030,640 A 4/1962 Gosman
3,048,514 A 8/1962 Bentele et al.
3,120,712 A 2/1964 Menken
3,121,430 A 2/1964 O'Reilly
3,204,678 A 9/1965 Worcester
3,251,076 A 5/1966 Burke
3,284,264 A 11/1966 O'Rourke
3,335,045 A 8/1967 Post
3,366,525 A 1/1968 Jackson
3,469,576 A 9/1969 Smith et al.
3,568,227 A 3/1971 Dunham
3,589,037 A 6/1971 Gallagher
3,608,215 A 9/1971 Fukuoka
3,685,176 A 8/1972 Rudy
3,758,964 A 9/1973 Nishimura
3,765,422 A 10/1973 Smith
4,017,931 A 4/1977 Golden
4,054,960 A 10/1977 Pettit et al.
4,115,934 A 9/1978 Hall
4,129,951 A 12/1978 Petrosky
4,167,795 A 9/1979 Lambert, Jr.
4,183,156 A 1/1980 Rudy
4,187,620 A 2/1980 Selner
4,217,705 A 8/1980 Donzis
4,219,945 A 9/1980 Rudy
4,271,606 A 6/1981 Rudy
4,287,250 A 9/1981 Rudy
4,292,702 A 10/1981 Phillips
4,297,797 A 11/1981 Meyers
4,305,212 A 12/1981 Coomer
4,328,599 A 5/1982 Mollura
4,358,902 A 11/1982 Cole et al.
4,431,003 A 2/1984 Sztancsik
4,446,634 A 5/1984 Johnson et al.
4,458,430 A 7/1984 Peterson
4,483,030 A 11/1984 Flick et al.
4,486,964 A 12/1984 Rudy
4,506,460 A 3/1985 Rudy
4,547,919 A 10/1985 Wang
4,662,087 A 5/1987 Beuch
4,670,995 A 6/1987 Huang
4,686,130 A 8/1987 Kon
4,698,884 A 10/1987 Graebe
4,722,131 A 2/1988 Huang
4,744,157 A 5/1988 Dubner
4,779,359 A 10/1988 Famolare, Jr.
4,782,602 A 11/1988 Lakic
4,803,029 A 2/1989 Iversen et al.
4,817,304 A 4/1989 Parker et al.
4,823,482 A 4/1989 Lakic
4,845,338 A 7/1989 Lakic
4,845,861 A 7/1989 Moumdjian
4,874,640 A 10/1989 Donzis
4,891,855 A 1/1990 Cheng-Chung
4,906,502 A 3/1990 Rudy
4,912,861 A 4/1990 Huang
4,936,029 A 6/1990 Rudy
4,965,899 A 10/1990 Sekido et al.
4,972,611 A 11/1990 Swartz et al.
4,991,317 A 2/1991 Lakic
4,999,931 A 3/1991 Vermeulen
4,999,932 A 3/1991 Grim
5,014,449 A 5/1991 Richard et al.
5,022,109 A 6/1991 Pekar
5,025,575 A 6/1991 Lakic
5,042,176 A 8/1991 Rudy
5,044,030 A 9/1991 Balaton
5,046,267 A 9/1991 Kilgore et al.
5,083,361 A 1/1992 Rudy
5,104,477 A 4/1992 Williams et al.
5,131,174 A * 7/1992 Drew et al. ..... 36/35 B
5,155,927 A 10/1992 Bates et al.
5,158,767 A 10/1992 Cohen et al.
5,179,792 A 1/1993 Brantingham
5,193,246 A 3/1993 Huang
5,199,191 A 4/1993 Moumdjian
5,224,277 A 7/1993 Sang Do
5,224,278 A 7/1993 Jeon
5,228,156 A 7/1993 Wang
5,235,715 A 8/1993 Donzis
5,238,231 A 8/1993 Huang
5,245,766 A 9/1993 Warren
5,253,435 A 10/1993 Auger et al.
5,257,470 A 11/1993 Auger et al.
5,297,349 A 3/1994 Kilgore
5,335,382 A 8/1994 Huang
5,337,492 A 8/1994 Anderie et al.
5,353,523 A 10/1994 Kilgore et al.
5,355,552 A 10/1994 Huang
5,367,791 A 11/1994 Gross et al.
5,406,719 A 4/1995 Potter
5,425,184 A 6/1995 Lyden et al.
5,477,626 A 12/1995 Kwon
5,493,792 A 2/1996 Bates et al.
5,543,194 A 8/1996 Rudy
5,545,463 A 8/1996 Schmidt et al.
5,558,395 A 9/1996 Huang
5,572,804 A 11/1996 Skaja et al.
5,595,004 A 1/1997 Lyden et al.
5,625,064 A 5/1997 Lyden et al.
5,625,964 A 5/1997 Lyden et al.
5,669,161 A 9/1997 Huang
5,686,167 A 11/1997 Rudy
5,704,137 A 1/1998 Dean et al.
5,713,141 A 2/1998 Mitchell et al.
5,741,568 A 4/1998 Rudy
5,753,061 A 5/1998 Rudy
5,755,001 A 5/1998 Potter et al.
5,771,606 A 6/1998 Litchfield et al.
5,802,739 A 9/1998 Potter et al.
5,830,553 A 11/1998 Huang
5,832,630 A 11/1998 Potter
5,846,063 A 12/1998 Lakic
5,902,660 A 5/1999 Huang
5,907,911 A 6/1999 Huang
5,916,664 A 6/1999 Rudy
5,925,306 A 7/1999 Huang
5,937,462 A 8/1999 Huang
5,952,065 A 9/1999 Mitchell et al.
5,976,451 A 11/1999 Skaja et al.
5,979,078 A 11/1999 McLaughlin
5,987,780 A 11/1999 Lyden et al.
5,993,585 A 11/1999 Goodwin et al.
6,013,340 A 1/2000 Bonk et al.
6,027,683 A 2/2000 Huang
6,029,962 A 2/2000 Shorten et al.
6,055,746 A 5/2000 Lyden et al.
6,065,150 A 5/2000 Huang
6,098,313 A 8/2000 Skaja
6,119,371 A 9/2000 Goodwin et al.
6,127,010 A 10/2000 Rudy
6,128,837 A 10/2000 Huang
6,253,466 B1 7/2001 Harmon-Weiss et al.

| | | | |
|---|---|---|---|
| 6,374,514 | B1 | 4/2002 | Swigart |
| 6,457,262 | B1 | 10/2002 | Swigart |
| 6,550,085 | B2 | 4/2003 | Roux |
| 2001/0011427 | A1 | 8/2001 | Beard |
| 2002/0013967 | A1 | 2/2002 | Roux |
| 2003/0056400 | A1 | 3/2003 | Potter et al. |
| 2003/0150132 | A1 | 8/2003 | Lin |
| 2003/0200678 | A1 | 10/2003 | Nishiwald et al. |
| 2003/0208930 | A1 | 11/2003 | Swigart |

FOREIGN PATENT DOCUMENTS

| | | |
|---|---|---|
| FR | 2407008 | 5/1979 |
| FR | 2483321 | 4/1981 |
| FR | 2614510 | 4/1987 |
| FR | 2639537 | 11/1988 |
| GB | 14955 | 8/1893 |
| GB | 7441 | 3/1906 |
| GB | 233387 | 1/1924 |
| GB | 978654 | 12/1964 |
| GB | 1128764 | 10/1968 |
| JP | 4-266718 | 9/1992 |
| JP | 6-181802 | 7/1994 |
| WO | WO89/10074 | 11/1989 |
| WO | WO90/10396 | 9/1990 |
| WO | WO91/11928 | 8/1991 |
| WO | WO91/11931 | 8/1991 |
| WO | WO92/08384 | 5/1992 |
| WO | WO95/20332 | 8/1995 |
| WO | WO 01/19211 | 3/2001 |

* cited by examiner

FOOTWEAR SOLE STRUCTURE INCORPORATING A CUSHIONING COMPONENT

BACKGROUND OF THE INVENTION

1. Field of the Invention

The present invention relates to footwear. The invention concerns, more particularly, a cushioning component suitable for footwear applications, wherein the cushioning component includes a lobed chamber and inserts positioned between the lobes.

2. Description of Background Art

A conventional article of footwear includes two primary elements, an upper and a sole structure. With respect to athletic footwear, for example, the upper generally includes multiple material layers, such as textiles, foam, and leather, that are stitched or adhesively bonded together to form a void on the interior of the footwear for securely and comfortably receiving a foot. The sole structure has a layered configuration that includes an insole, a midsole, and an outsole. The insole is a thin cushioning member positioned within the void and adjacent the foot to enhance footwear comfort. The midsole forms a middle layer of the sole structure and is often formed of a foam material, such as polyurethane or ethylvinylacetate. The outsole is secured to a lower surface of the midsole and provides a durable, wear-resistant surface for engaging the ground.

Midsoles formed of conventional foam materials compress resiliently under an applied load, thereby attenuating forces and absorbing energy associated with walking or running, for example. The resilient compression of the foam materials is due, in part, to the inclusion of cells within the foam structure that define an inner volume substantially displaced by gas. That is, the foam materials include a plurality of pockets that enclose air. After repeated compressions, however, the cell structures may begin to collapse, which results in decreased compressibility of the foam. Accordingly, the overall ability of the midsole to attenuate forces and absorb energy deteriorates over the life of the midsole.

One manner of minimizing the effects of the cell structure collapse in conventional foam materials involves the use of a structure having the configuration of a fluid-filled chamber, as disclosed in U.S. Pat. No. 4,183,156 to Rudy, hereby incorporated by reference. The fluid-filled chamber has the structure of a bladder that includes an outer enclosing member formed of an elastomeric material that defines a plurality of tubular members extending longitudinally throughout the length of an article of footwear. The tubular members are in fluid communication with each other and jointly extend across the width of the footwear. U.S. Pat. No. 4,219,945 to Rudy, also incorporated by reference, discloses a similar fluid-filled chamber encapsulated in a foam material, wherein the combination of the fluid-filled chamber and the encapsulating foam material functions as a midsole.

U.S. Pat. No. 4,817,304 to Parker, et al., hereby incorporated by reference, discloses a foam-encapsulated, fluid-filled chamber in which apertures are formed in the foam and along side portions of the chamber. When the midsole is compressed, the chamber expands into the apertures. Accordingly, the apertures provide decreased stiffness during compression of the midsole, while reducing the overall weight of the footwear. Further, by appropriately locating the apertures in the foam material, the overall impact response characteristics may be adjusted in specific areas of the footwear.

The fluid-filled chambers described above may be manufactured by a two-film technique, wherein two separate layers of elastomeric film are formed to have the overall shape of the chamber. The layers are then welded together along their respective peripheries to form an upper surface, a lower surface, and sidewalls of the chamber, and the layers are welded together at predetermined interior locations to impart a desired configuration to the chamber. That is, interior portions of the layers are connected to form chambers of a predetermined shape and size at desired locations. The chambers are subsequently pressurized above ambient pressure by inserting a nozzle or needle, which is connected to a fluid pressure source, into a fill inlet formed in the chamber. After the chambers are pressurized, the nozzle is removed and the fill inlet is sealed, by welding for example.

Another manufacturing technique for manufacturing fluid-filled chambers of the type described above is through a blow-molding process, wherein a liquefied elastomeric material is placed in a mold having the desired overall shape and configuration of the chamber. The mold has an opening at one location through which pressurized air is provided. The pressurized air forces the liquefied elastomeric material against the inner surfaces of the mold and causes the material to harden in the mold, thereby forming the chamber to have the desired configuration.

Another type of chamber utilized in footwear midsoles is disclosed in U.S. Pat. Nos. 4,906,502 and 5,083,361, both to Rudy, and both hereby incorporated by reference. The chambers comprise a hermetically sealed outer barrier layer that is securely bonded over a double-walled fabric core. The double-walled fabric core has upper and lower outer fabric layers normally spaced apart from each another at a predetermined distance, and may be manufactured through a double needle bar Raschel knitting process. Connecting yarns, potentially in the form of multi-filament yarns with many individual fibers, extend internally between the facing surfaces of the fabric layers and are anchored to the fabric layers. The individual filaments of the connecting yarns form tensile restraining members that limit outward movement of the barrier layers to a desired distance.

U.S. Pat. Nos. 5,993,585 and 6,119,371, both issued to Goodwin et al., and both hereby incorporated by reference, also disclose chambers incorporating a double-walled fabric core, but without a peripheral seam located midway between the upper and lower surfaces of the chamber. Instead, the seam is located adjacent to the upper surface of the chamber. Advantages in this design include removal of the seam from the area of maximum sidewall flexing and increased visibility of the interior of the chamber, including the connecting yarns. The process used to manufacture a chamber of this type, involves the formation of a shell, which includes a lower surface and a sidewall, with a mold. The double-walled fabric core is placed on top of a covering layer, and the shell is placed over the covering layer and core. The assembled shell, covering layer, and core are then moved to a lamination station where radio frequency energy bonds opposite sides of the core to the shell and covering layer, and bonds a periphery of the shell to the covering layer. The chamber is then pressurized by inserting a fluid so as to place the connecting yarns in tension.

A process for thermoforming a chamber is disclosed in U.S. Pat. No. 5,976,451 to Skaja et al., hereby incorporated by reference, wherein a pair of flexible thermoplastic resin layers are heated and placed against a pair of molds, with a vacuum drawing the layers into the mold. The layers are then pressed together to form the chamber.

The fluid contained within the chambers discussed above may include any of the gasses disclosed in U.S. Pat. No.

4,340,626 to Rudy, such as hexafluoroethane and sulfur hexafluoride, for example. In addition, some chambers enclose gasses that include pressurized octafluorapropane, nitrogen, or air. The material forming outer layers of the chambers discussed above may be formed of a polymer material, such as a thermoplastic elastomer, that is substantially impermeable to the fluid within the chamber. More specifically, one suitable material is a film formed of alternating layers of thermoplastic polyurethane and ethylene-vinyl alcohol copolymer, as disclosed in U.S. Pat. Nos. 5,713,141 and 5,952,065 to Mitchell et al, hereby incorporated by reference. A variation upon this material wherein the center layer is formed of ethylene-vinyl alcohol copolymer; the two layers adjacent to the center layer are formed of thermoplastic polyurethane; and the outer layers are formed of a regrind material of thermoplastic polyurethane and ethylene-vinyl alcohol copolymer may also be utilized. Another suitable material is a flexible microlayer membrane that includes alternating layers of a gas barrier material and an elastomeric material, as disclosed in U.S. Pat. Nos. 6,082,025 and 6,127,026 to Bonk et al., both hereby incorporated by reference. Other suitable thermoplastic elastomer materials or films include polyurethane, polyester, polyester polyurethane, polyether polyurethane, such as cast or extruded ester-based polyurethane film. Additional suitable materials are disclosed in the '156 and '945 patents to Rudy, which were discussed above. In addition, numerous thermoplastic urethanes may be utilized, such as PELLETHANE, a product of the Dow Chemical Company; ELASTOLLAN, a product of the BASF Corporation; and ESTANE, a product of the B.F. Goodrich Company, all of which are either ester or ether based. Still other thermoplastic urethanes based on polyesters, polyethers, polycaprolactone, and polycarbonate macrogels may be employed, and various nitrogen blocking materials may also be utilized. Further suitable materials include thermoplastic films containing a crystalline material, as disclosed in U.S. Pat. Nos. 4,936,029 and 5,042,176 to Rudy, hereby incorporated by reference, and polyurethane including a polyester polyol, as disclosed in U.S. Pat. Nos. 6,013,340; 6,203,868; and 6,321,465 to Bonk et al., also hereby incorporated by reference.

The chambers discussed above are generally encapsulated within a polymer foam, which forms the midsole of the footwear. The chambers disclosed in U.S. Pat. Nos. 5,572,804 to Skaja et al. and 6,029,962 to Shorten et al., both hereby incorporated by reference, are formed of polymer layers with a plurality of indentations extending inward on opposite sides of the chamber. Indentations on a top surface of the chamber contact and are bonded with corresponding indentations on a bottom side of the chamber to restrain outward movement of the polymer layers. In addition, polymer elements having shapes that correspond with the shapes of the indentations are positioned within the indentations and bonded to the exterior of the bladder to provide additional support. The chamber and the polymer elements are then encapsulated within a foam material to form a midsole.

SUMMARY OF THE INVENTION

The present invention is a cushioning component for an article of footwear that includes a chamber and a plurality of inserts. The chamber has a first surface and an opposite second surface peripherally joined to form a volume for receiving a fluid. The first surface and the second surface are devoid of internal connections that secure interior portions of the first surface to interior portions of the second surface, and the first surface and the second surface define a plurality of lobes extending outward from a central area of the chamber. The lobes are in fluid communication with the central area, and the lobes define spaces positioned between the lobes that are located adjacent to each other. The inserts are positioned within the spaces and formed of a resilient material.

Layers of material extend over the first surface and the second surface, and the inserts are secured to the layers of material such that the inserts extend between the lobes of the chamber. Each insert includes a first portion positioned adjacent the first surface and a second portion positioned adjacent the second surface, with first portion being secured to the second portion. In some embodiments of the invention the first portion is formed of three concave structures, and the second portion is also formed of three concave structures. By varying the configuration of the structures, and particularly the inserts, the cushioning properties of the component may be modified.

The fluid within the chamber may be at a pressure that is substantially equal to the ambient pressure surrounding the footwear, and the fluid may be air, for example. The relatively low pressure permits the first surface and the second surface to retain a desired shape without the internal connections between the first surface and the second surface. That is, the relatively low pressure permits the first surface and the second surface to have a flat or curved shape without the need for tensile members located within the chamber that restrain outward movement in some pressurized chambers.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

DETAILED DESCRIPTION OF THE INVENTION

The following discussion and accompanying figures disclose articles of athletic footwear having midsoles that incorporate cushioning components in accordance with the present invention. Concepts related to the footwear, and more particularly the cushioning components, are disclosed with reference to footwear having a configuration that is suitable for athletic activities. The invention is suitable, therefore, for footwear designed to be utilized during training and competition for such activities as running, basketball, walking, tennis, and soccer, for example. In addition, the invention may also be applied to non-athletic footwear styles, including dress shoes, loafers, sandals, and work boots. Accordingly, one skilled in the relevant art will appreciate that the concepts disclosed herein may be applied to a wide variety of footwear styles, in addition to the specific style discussed in the following material and depicted in the accompanying figures.

Figure 1:
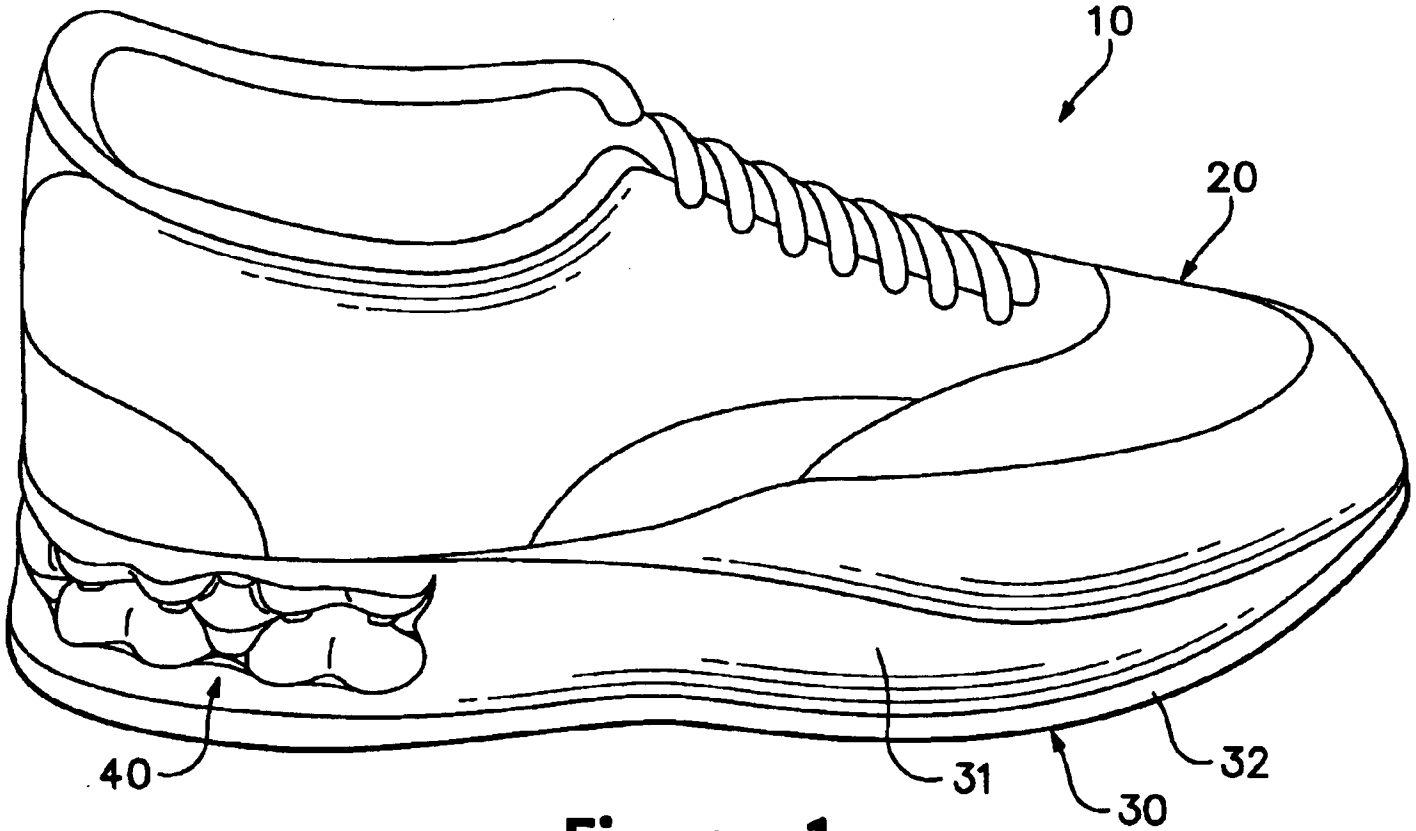
FIG. 1 is a perspective view of an article of footwear having a midsole with a cushioning component in accordance with an embodiment of the present invention.

An article of footwear 10 is depicted in FIG. 1 and includes an upper 20 and a sole structure 30. Upper 20 has a substantially conventional configuration and includes a plurality of elements, such as textiles, foam, and leather materials, that are stitched or adhesively bonded together to form an interior void for securely and comfortably receiving the foot. Sole structure 30 is positioned below upper 20 and includes two primary elements, a midsole 31 and an outsole 32. Midsole 31 is secured to a lower surface of upper 20, through stitching or adhesive bonding for example, and operates to attenuate forces and absorb energy as sole structure 30 contacts the ground. That is, midsole 31 is structured to provide the foot with cushioning during walking or running, for example. Outsole 32 is secured to a lower surface of midsole 31 and is formed of a durable, wear-resistant material that engages the ground. In addition, sole structure 30 may include an insole 33, which is a thin cushioning member, located within the void and adjacent to the foot to enhance the comfort of footwear 10.

Midsole 31 is primarily formed of a polymer foam material, such as polyurethane or ethylvinylacetate, that at least partially encapsulates a cushioning component 40. Component 40 is utilized to supplement the force attenuation and energy absorption properties of midsole 31, thereby providing additional cushioning to sole structure 30. In addition, component 40 may enhance the stability of sole structure 30. As will be discussed in greater detail following a discussion of the structure of component 40, a desired degree of cushioning and stability is imparted by pressure ramping, the structural and material properties of component 40, and film tensioning.

Figure 2:
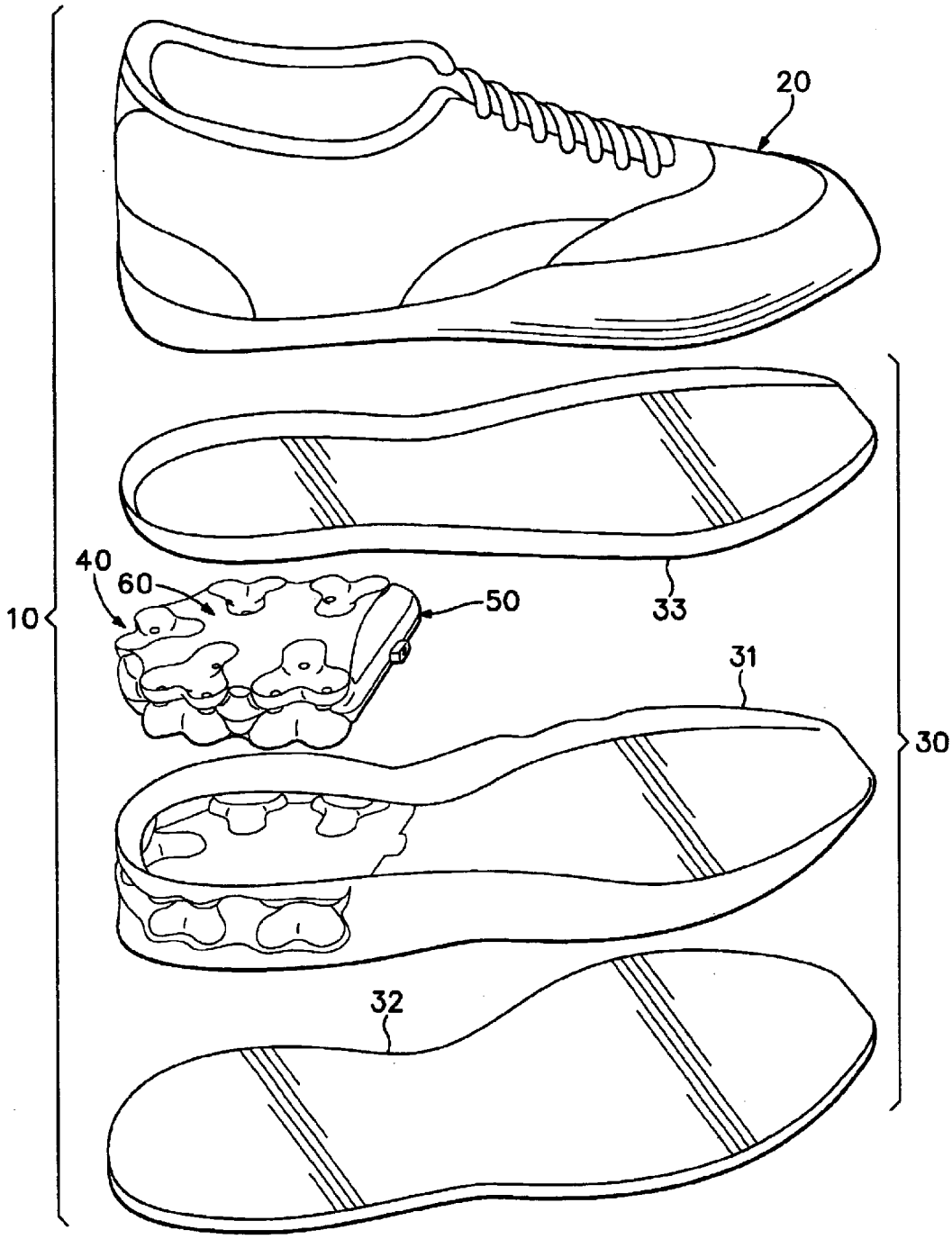
FIG. 2 is an exploded perspective view of the footwear.
Figure 3:
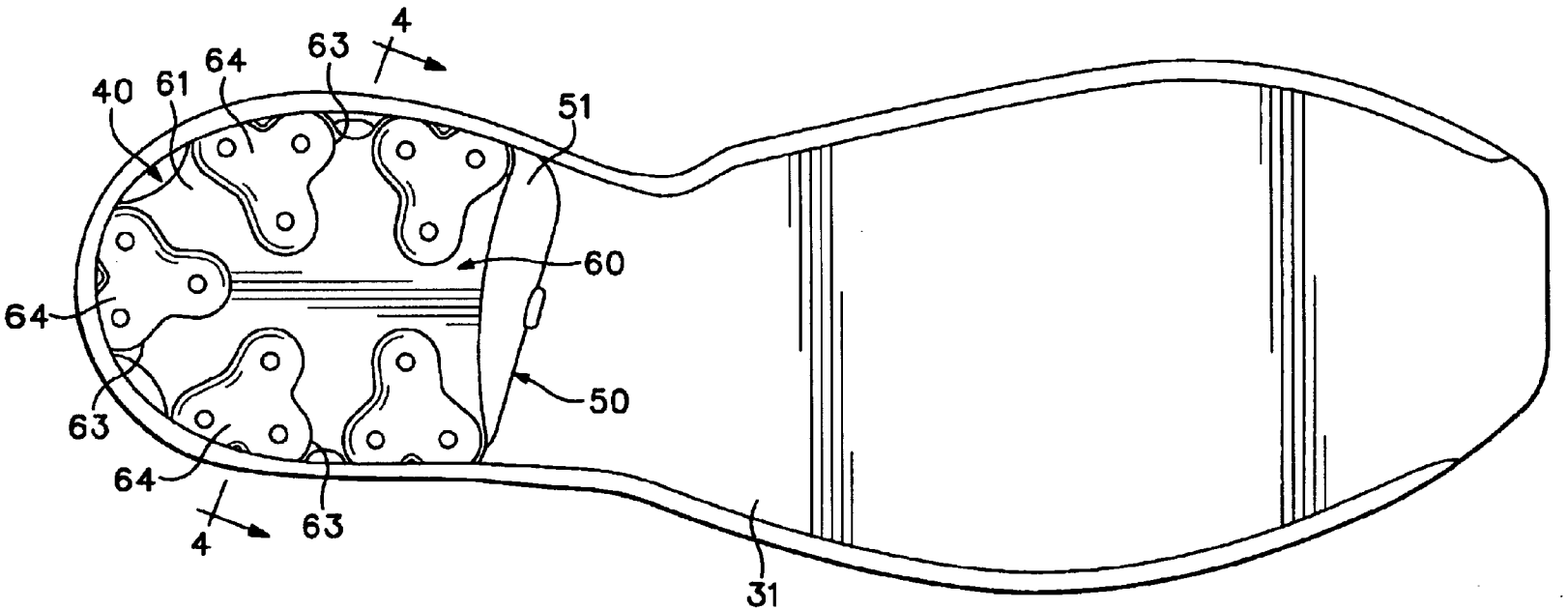
FIG. 3 is a top plan view of the midsole.
Figure 4:
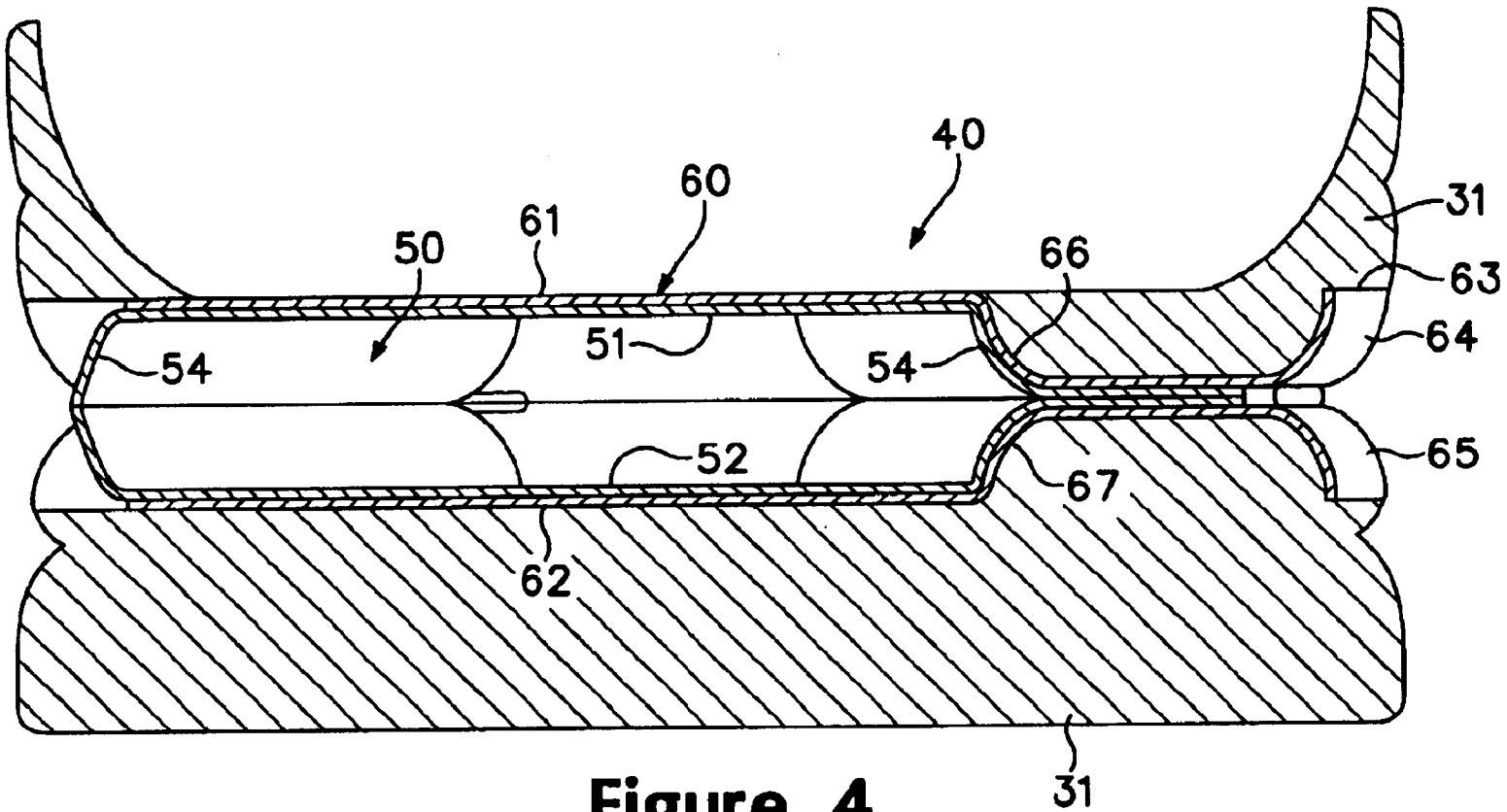
FIG. 4 is a cross-sectional view of the midsole, as defined by line 4—4 in FIG. 3.
Figure 5:
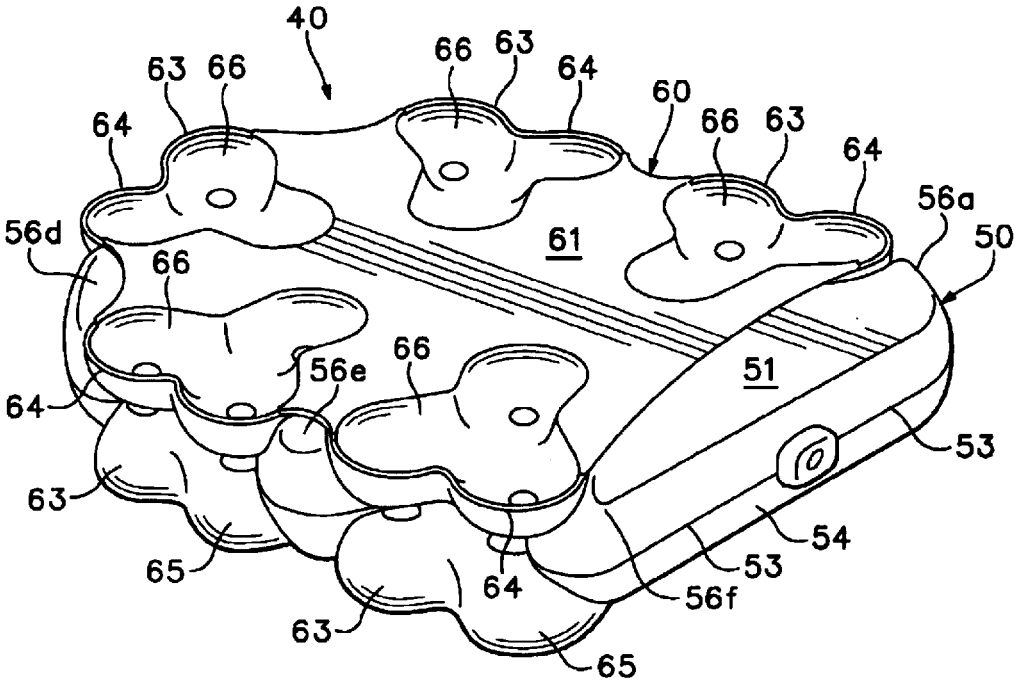
FIG. 5 is a perspective view of the cushioning component.
Figure 6:
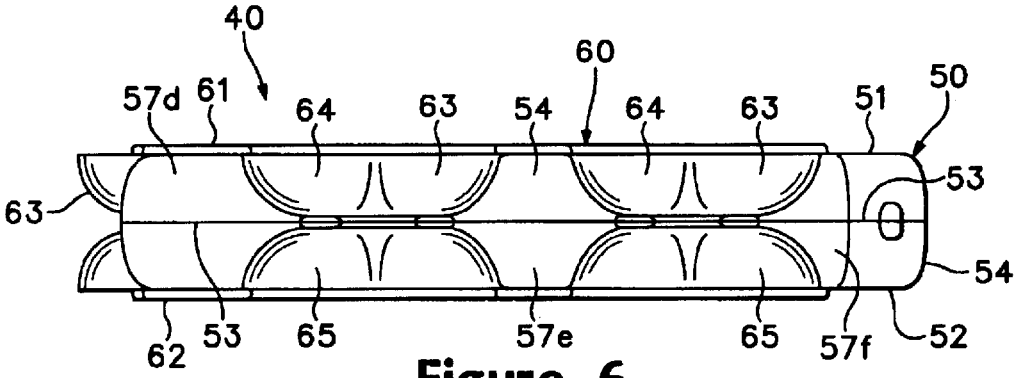
FIG. 6 is a side elevational view of the cushioning component.
Figure 7:
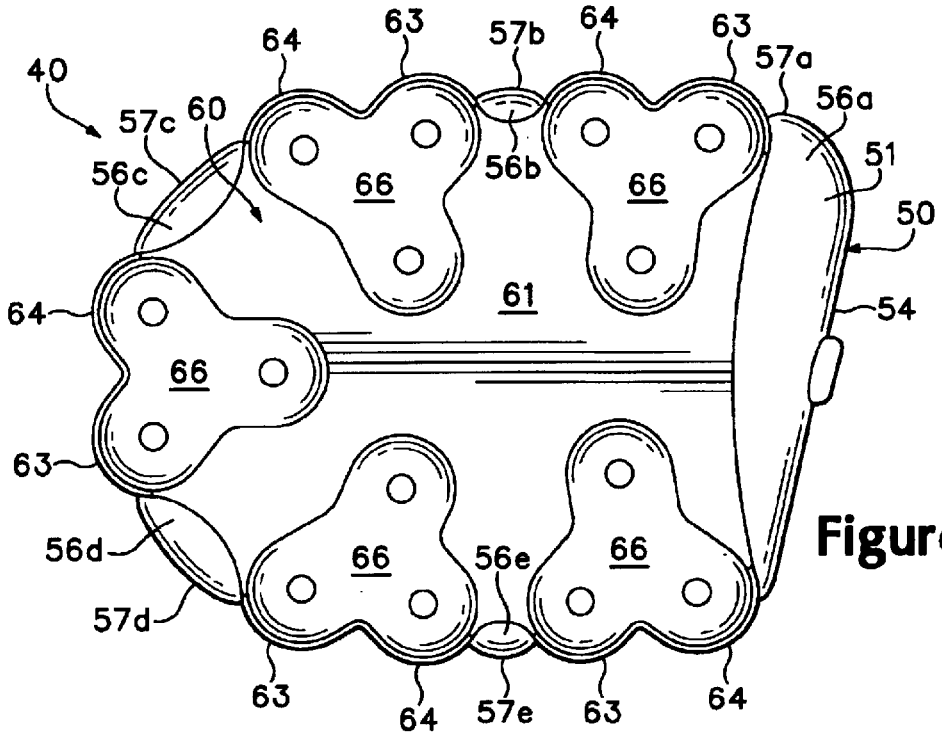
FIG. 7 is a top plan view of the cushioning component.
Figure 8:
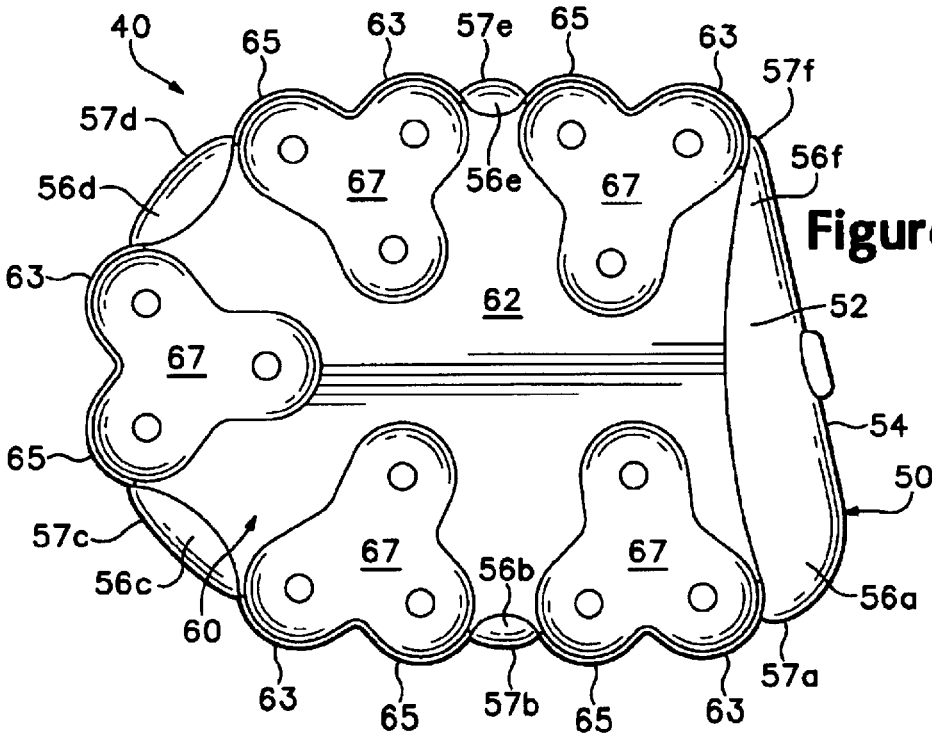
FIG. 8 is a bottom plan view of the cushioning component.
Figure 9:
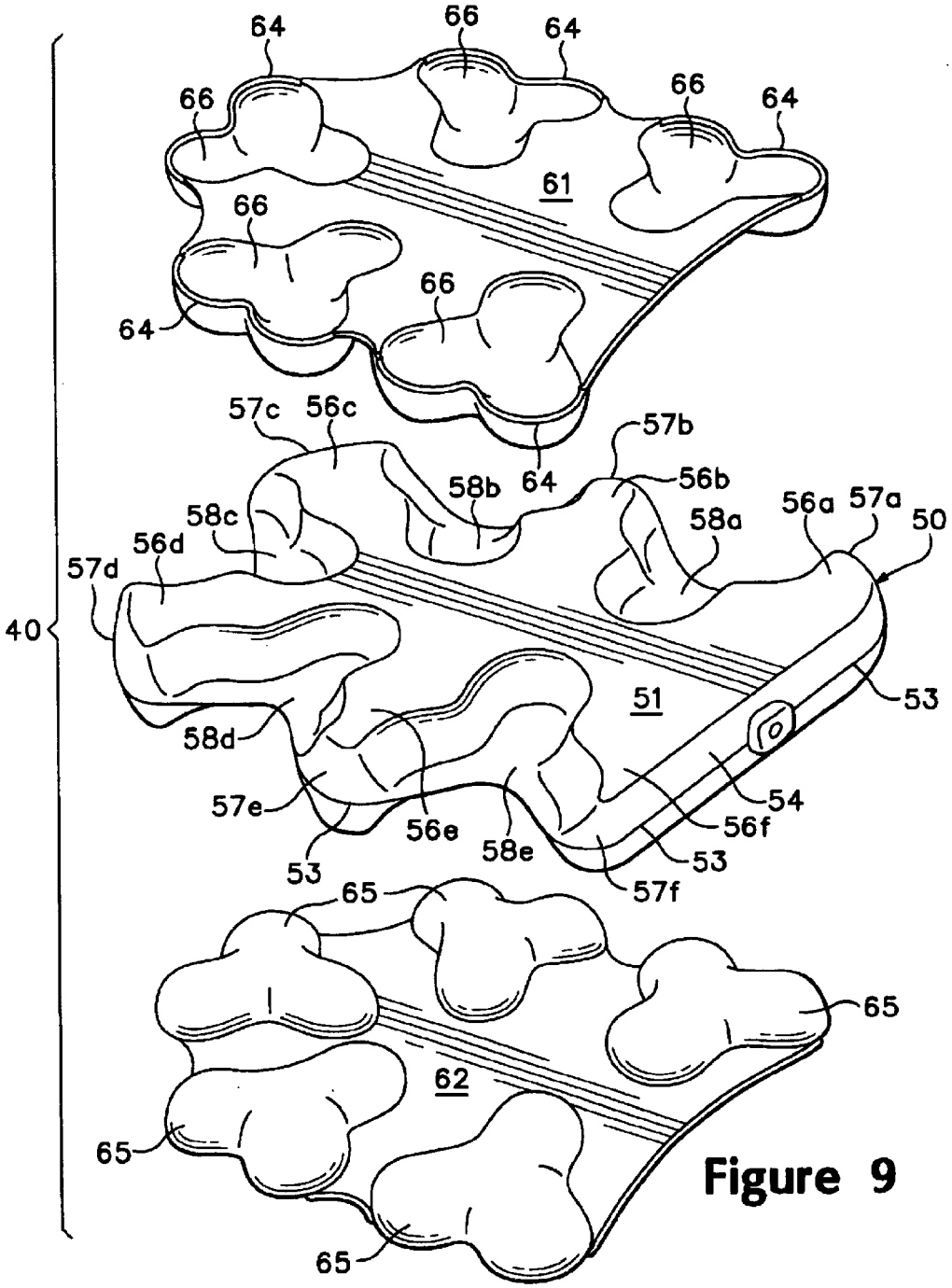
FIG. 9 is an exploded perspective view of the cushioning component.
Figure 16:
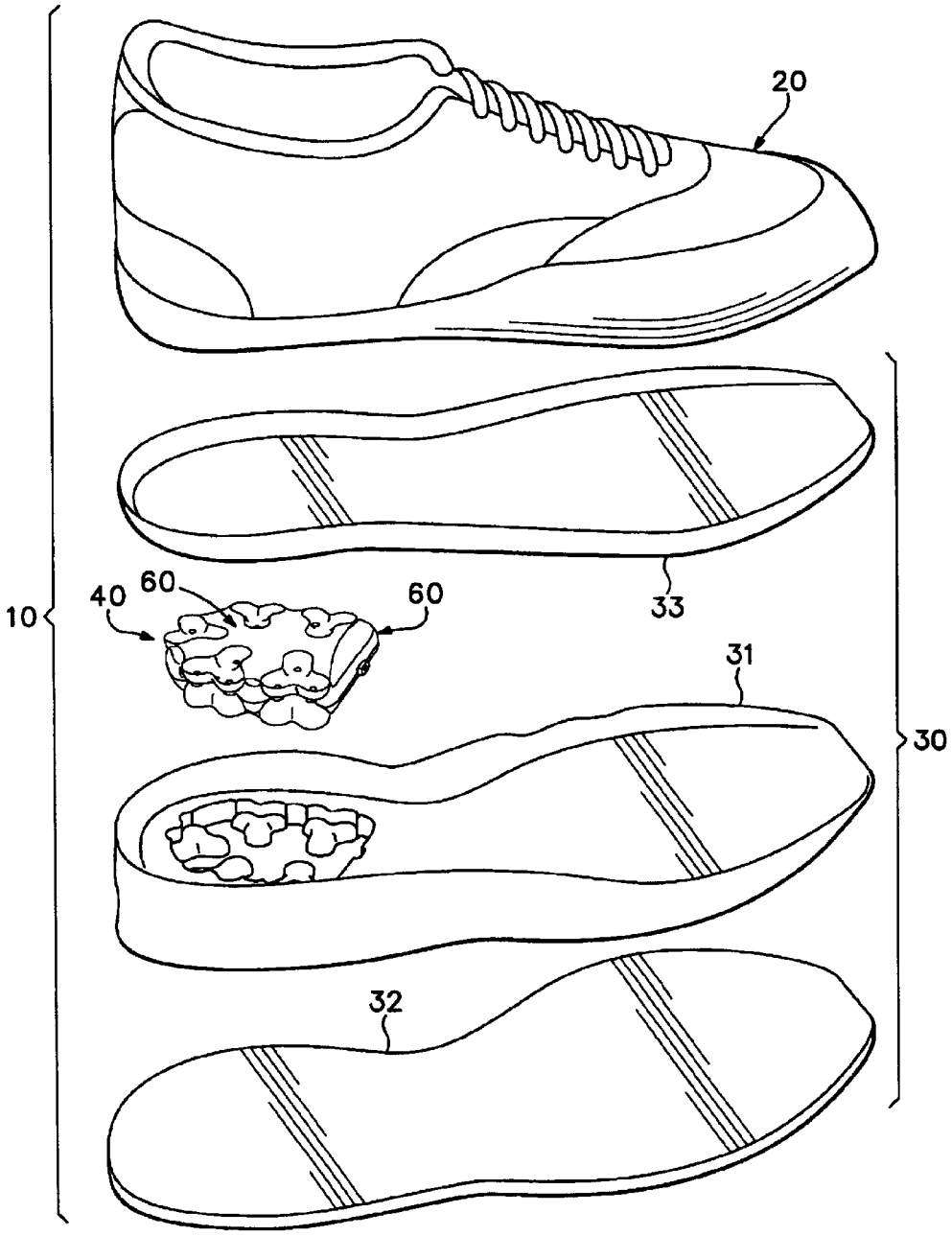
FIG. 16 is an exploded perspective view of another article of footwear having a midsole with a cushioning component in accordance with an embodiment of the present invention.
Figure 17:
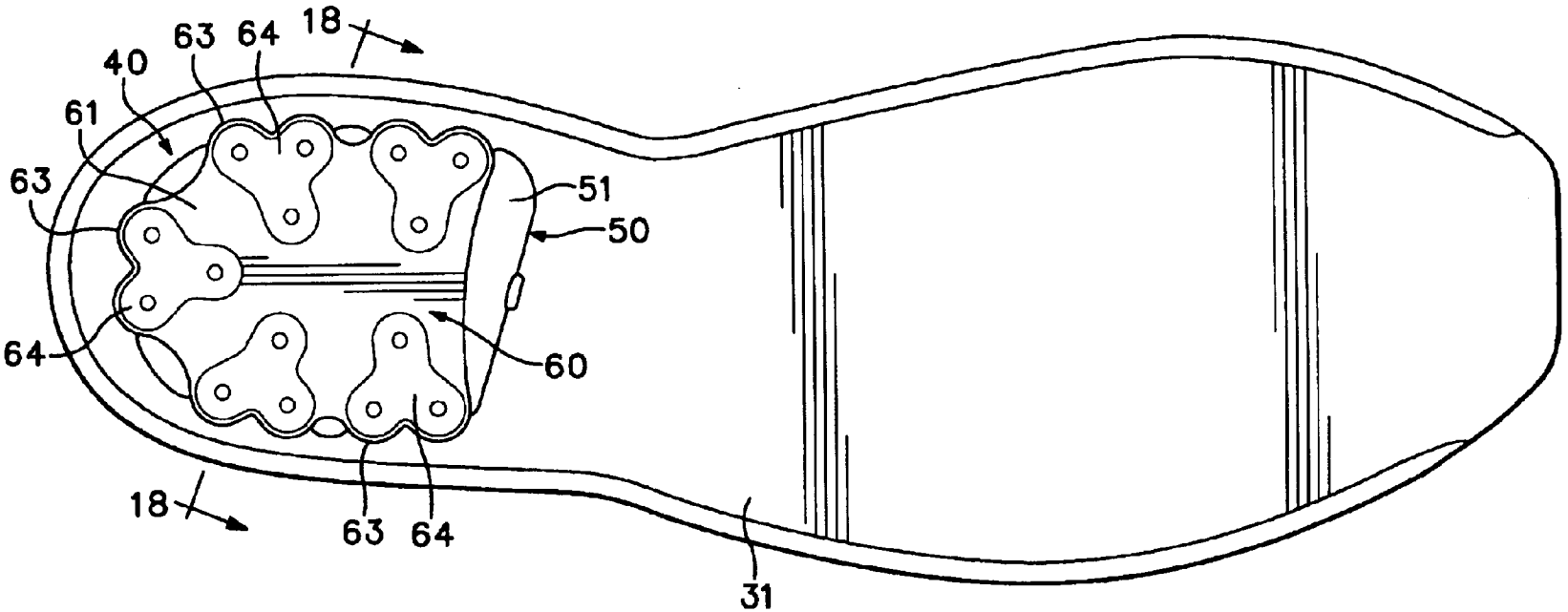
FIG. 17 is a top plan view of the midsole from the footwear of FIG. 16.
Figure 18:
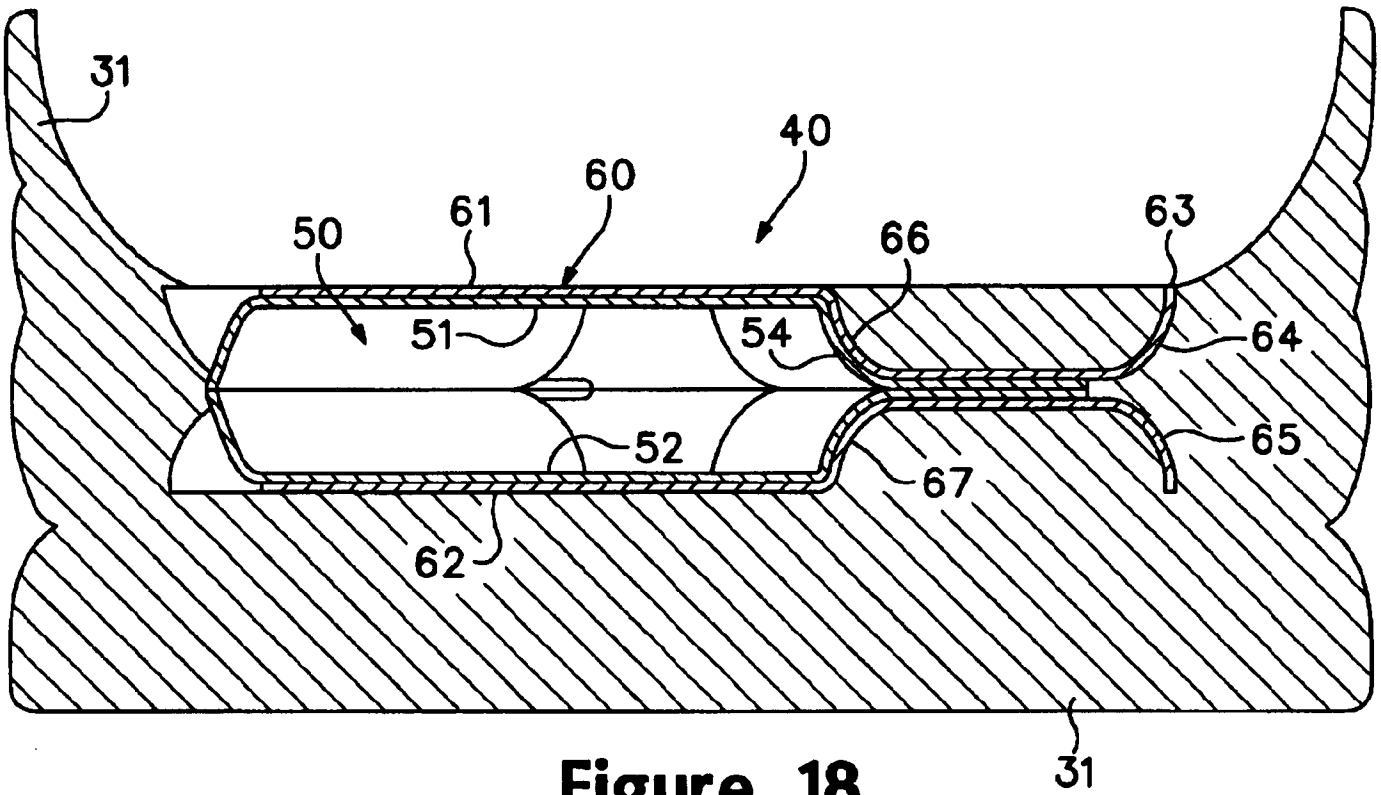
FIG. 18 is a cross-sectional view of the midsole, as defined by line 18—18 in FIG. 17.

The specific position of component 40 with respect to midsole 31 may vary significantly within the scope of the present invention. As depicted in FIGS. 2–4, component 40 is substantially coextensive with an upper surface of midsole 31. Accordingly, the upper surface of component 40 is generally coplanar with the upper surface of the polymer foam material forming midsole 31. In other embodiments, however, component 40 may be embedded within the foam material of midsole 31, or may be substantially coextensive with a lower surface of midsole 31, for example. Component 40 is also depicted as being positioned in a heel region of midsole 31, which generally corresponds with the area of highest initial load during footstrike. Component 40 may, however, be positioned in any region of midsole 31 to obtain a desired degree of cushioning response. In addition, when encapsulated by the polymer foam material in midsole 31, a portion of component 40 may extend to an edge 34 of midsole 31, and may extend through edge 34 such that component 40 is visible from the exterior of footwear 10, as depicted in FIGS. 1–3. Alternately, the edges of chamber 40 may be entirely embedded within the foam material of midsole 31, as depicted in the alternate embodiment of FIGS. 16–18. Furthermore, midsole 31 may include multiple components having the general configuration of component 40. The extent to which the foam material extends into the contours of component 40 may also vary. As depicted in FIG. 4, the foam material extends along upper and lower surfaces of component 40, and the foam material extends into indentations 66 and 67. In some embodiments, however, the foam material may be absent from indentations 66 and 67.

The primary elements of component 40, which is depicted individually in FIGS. 5–9, are a chamber 50 and a covering element 60. Chamber 50 has a first surface 51 and an opposite second surface 52 that are bonded together to form a peripheral seam 53. Portions of surfaces 51 and 52 have a generally planar configuration and are uniformly spaced apart from each other. In other embodiments one or both of first surface 51 and second surface 52 may be curved or may have an otherwise contoured configuration.

Figure 10:
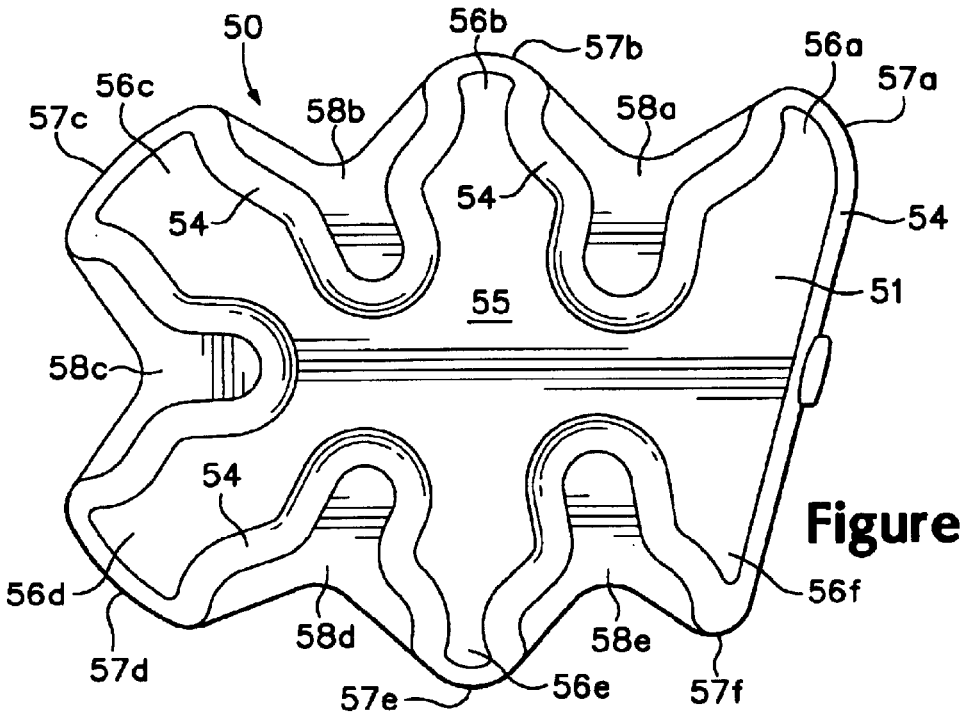
FIG. 10 is a top plan view of a chamber portion of the cushioning component.
Figure 11:
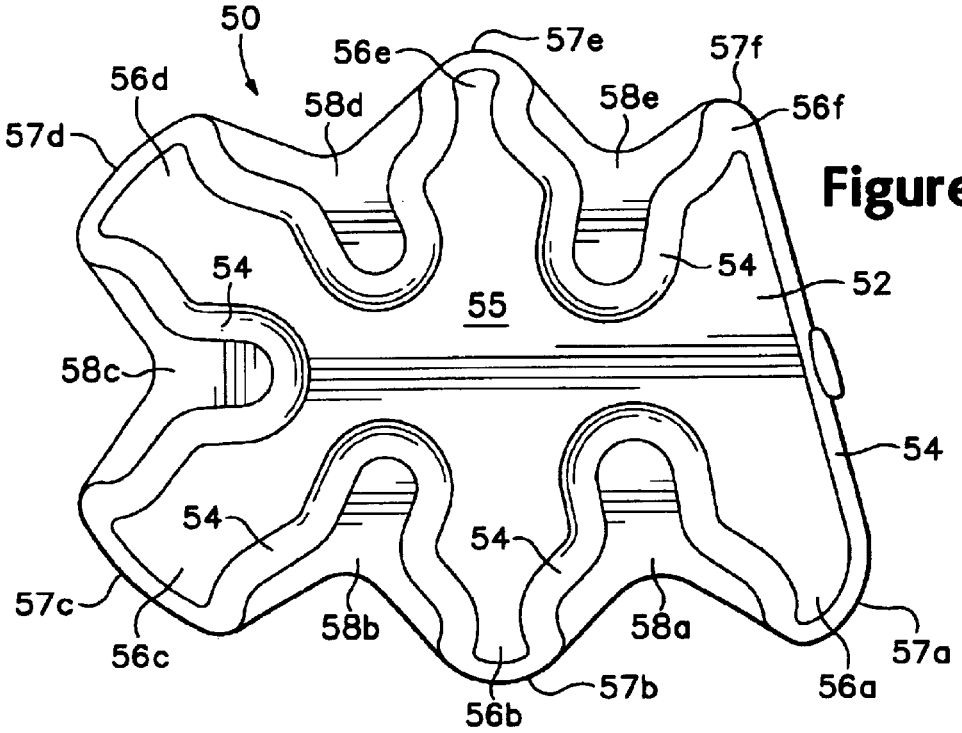
FIG. 11 is a bottom plan view of the chamber portion of the cushioning component.
Figure 12:
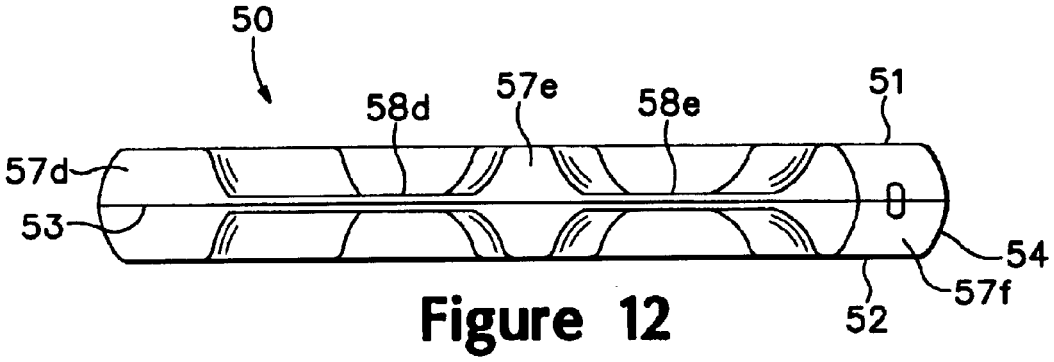
FIG. 12 is a side elevational view of the chamber portion of the cushioning component.

The areas of surfaces 51 and 52 immediately adjacent to peripheral seam 53 form a sidewall 54 of chamber 50. Surfaces 51 and 52 each form a central area 55 and six lobes 56*a*–56*f* extending outward from central area 55. Lobes 56*a*–56*f* each have a distal end 57*a*–57*f*, respectively, positioned opposite central area 55. Although six lobes 56*a*–56*f* are depicted and discussed herein, any number of lobes ranging from three to twenty is intended to fall within the scope of the present invention. A suitable number of lobes, however, ranges from five to nine. Chamber 50 is depicted separate from covering element 60 in FIGS. 10–12. In forming lobes 56*a*–56*f* portions of the polymer material of surfaces 51 and 52 are bonded together between lobes 56*a*–56*f* to form bonded areas 58*a*–58*e*, which provide an area for securing covering element 60 to chamber 50.

A variety of materials may be utilized to form chamber 50, including the polymeric materials that are conventionally utilized in forming the outer layers of fluid-filled chambers for footwear, as discussed in the Background of the Invention section. In contrast with a majority of the prior art chamber structures, however, the fluid within chamber 50 is at ambient pressure or at a pressure that is slightly elevated from ambient. Accordingly, the pressure of the fluid within chamber 50 may range from a gauge pressure of zero to five pounds per square inch. In further embodiments of chamber 50, however, the pressure of the fluid within chamber 50 may exceed five pounds per square inch. Due to the relatively low pressure within chamber 50, the materials utilized to form first surface 51 and second surface 52 need not provide the barrier characteristics that operate to retain the relatively high fluid pressures of prior art chambers.

Accordingly, a wide range of polymeric materials such as thermoplastic urethane may be utilized to form chamber 50, and a variety of fluids such as air may be utilized within chamber 50. Furthermore, the wide range of polymeric materials may be selected based primarily upon the engineering properties of the material, such as the dynamic modulus and loss tangent, rather than the ability of the material to prevent the diffusion of the fluid contained by chamber 50. When formed of thermoplastic polyurethane, first surface 51 and second surface 52 may have a thickness of approximately 0.040 inches, and may range from 0.030 to 0.060 inches, for example.

The relatively low pressure of the fluid within chamber 50 also provides another difference between chamber 50 and prior art chambers. The relatively high pressure in prior art chambers often requires the formation of a plurality of internal connections between the polymer layers to prevent the chamber from expanding outward to a significant degree. That is, internal connections were utilized in prior art chambers to control overall thickness of the chambers, but also had the effect of limiting compression of the prior art chambers. In contrast, chamber 50 does not have internal connections between first surface 51 and second surface 52 due to the relatively low pressure, thereby permitting a greater degree of compression.

Chamber 50 may be manufactured through a variety of manufacturing techniques, including blow-molding, thermoforming, and rotational molding, for example. With regard to the blow-molding technique, thermoplastic material is placed in a mold having the general shape of chamber 50 and pressurized air is utilized to induce the material to coat surfaces of the mold. In the thermoforming technique, layers of thermoplastic material are placed between corresponding portions of a mold, and the mold is utilized to compress the layers together at peripheral locations of chamber 50. A positive pressure may be applied between the layers of thermoplastic material to induce the layers into the contours of the mold. In addition, a vacuum may be induced in the area between the layers and the mold to draw the layers into the contours of the mold.

The structure of chamber 50 disclosed herein is intended to provide an example of a suitable fluid-filled bladder for component 40. In further embodiments of the invention, chamber 50 may have lesser or greater numbers of lobes 56*a*–56*f*, bonded areas 58*a*–58*e* may be absent, the fluid pressure within chamber 50 may be substantially greater than ambient pressure, or peripheral seam 53 may be located adjacent the planar area of first surface 51 to enhance visibility through sidewall 54, for example.

Covering element 60 extends over surfaces 51 and 52 and extends between adjacent lobes 56*a*–56*f*. The primary portions of covering element 60 are a first layer 61 that is positioned adjacent to first surface 51, a second layer 62 that is positioned adjacent to second surface 52, and a plurality of inserts 63 that extend between and connect layers 61 and 62. As depicted in the figures, first layer 61 has a generally planar structure that contacts and extends over the planar area of first surface 51. Accordingly, first layer 61 provides a thin, planar member that covers portions of first surface 51. Similarly, second layer 62 has a generally planar structure that contacts and extends over the planar area of second surface 52. In alternate embodiments, one or both of first layer 61 and second layer 62 may have a curved or otherwise contoured configuration. Inserts 63 are positioned between adjacent lobes 56*a*–56*f*, and inserts 63 extend along sidewall 54 to connect first layer 61 and second layer 62. Accordingly, layers 61 and 62 are secured together and secured to chamber 50 by inserts 63. Although inserts 63 are sufficient to secure the position of layers 61 and 62 relative to chamber 50, an adhesive may also be utilized to generally secure covering element 60 to chamber 50. As discussed, inserts 63 are positioned between lobes 56*a*–56*f*. Accordingly, distal ends 57*a*–57*f* protrude outward between inserts 63 and are visible from sides of component 40. Alternately, the length of lobes 56*a*–56*f* may be decreased such that distal ends 57*a*–57*f* are not visible.

Each insert 63 includes a first portion 64 that is connected to a second portion 65. First portion 64 has a concave structure and lies adjacent to the area of sidewall 54 formed by first surface 51. With regard to the concave structure, each first portion 64 includes an indentation 66 having three depressed areas arranged in a Y configuration that form a structure generally resembling a clover leaf. The three depressed areas in each indentation 66 are arranged, therefore, in a generally triangular pattern, with one of the depressed areas being spaced inward from sides of component 40 and two of the depressed areas forming the sides of component 40.

The structure of second portion 65 is similar to the structure of first portion 64. Accordingly, second portion 65 has a concave structures and lies adjacent to the area of sidewall 54 formed by second surface 52. With regard to the concave structure, each second portion 65 includes an indentation 67 having three depressed areas arranged in a Y configuration that form a structure generally resembling a clover leaf. The three depressed areas in each indentation 67 are arranged, therefore, in a generally triangular pattern, with one of the depressed areas being spaced inward from sides of component 40 and two of the depressed areas forming the sides of component 40.

Based upon the above discussion, inserts 63 may form a structure that extends through the spaces between lobes 56*a*–56*f*. As depicted in the figures, the exterior of inserts 63 have a rounded shape, and indentations 66 and 67 cooperatively taper to a lesser width adjacent to peripheral seam 53. In other embodiments however, inserts 63 and indentations 66 and 67 may have a constant thickness or may taper outwards. In general, however, inserts 63 generally extend through the spaces between lobes 56*a*–56*f*.

In manufacturing covering element 60, first layer 61 may be formed integral with each first portion 64. Similarly, second layer 62 may be formed integral with each second portion 65. First layer 61 and second layer 62 are then positioned on opposite sides of chamber 50 such that each first portion 64 aligns with each second portion 65. Bonds are then formed between each first portion 64 and second portion 65 to secure covering element 60 to chamber 50. Each indentation 66 and 67 is positioned adjacent to one of bonded areas 58*a*–58*e* such that bonded areas 58*a*–58*e* extend between at least a portion of each adjacent first portion 64 and second portion 65. Accordingly, each first portion 64 and each second portion 65 are effectively bonded to bonded areas 58*a*–58*e*. In general, however, bonded areas 58*a*–58*e* do not extend between exterior portions of first portions 64 and second portions 65. Accordingly, exterior portions of first portions 64 and second portions 65 are bonded directly to each other.

A variety of materials may be utilized to form covering element 60, including various elastomer and thermoplastic elastomer materials. In some embodiments, covering element 60 may be formed of a thermoplastic polyurethane or PEBAX, which is manufactured by the Atofina Company. PEBAX, which is a polyether block amide, provides a variety of characteristics that benefit the present invention, including high impact resistance at low temperatures, few property variations in the temperature range of –40 degrees Celsius to positive 80 degrees Celsius, resistance to degradation by a variety of chemicals, and low hysteresis during alternative flexure. Composite materials may also be formed by incorporating glass fibers or carbon fibers into the polymer materials discussed above.

Figure 13:
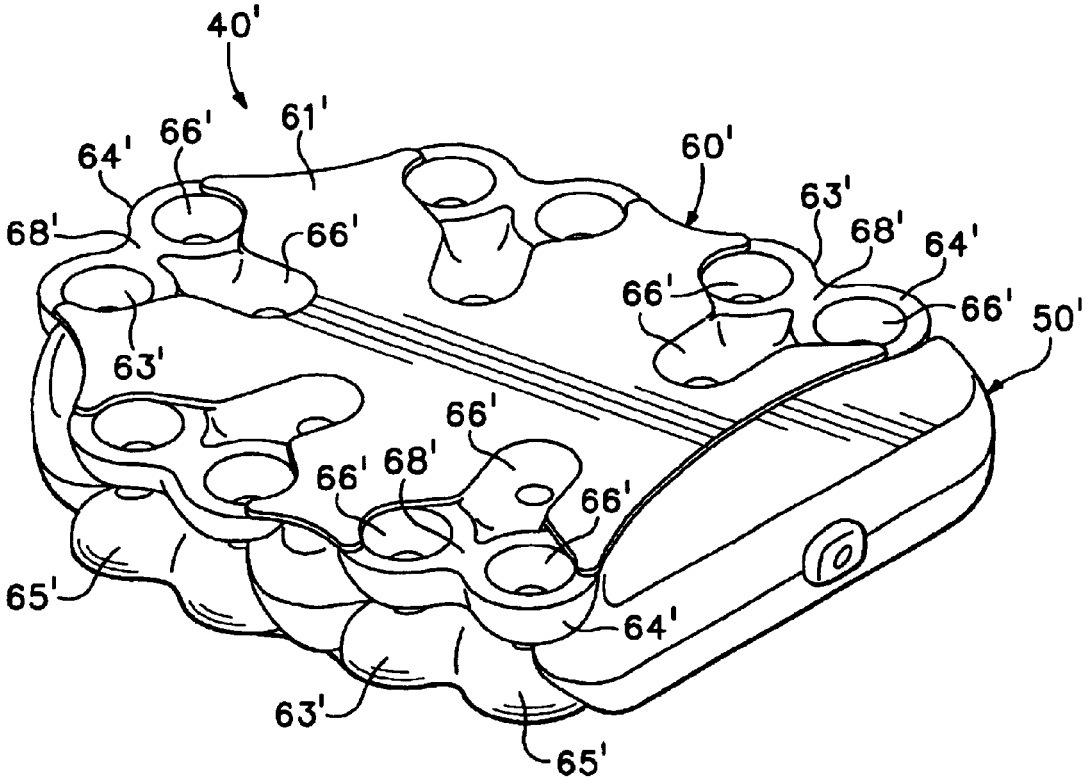
FIG. 13 is a perspective view of a cushioning component in accordance with another embodiment of the present invention.
Figure 14:
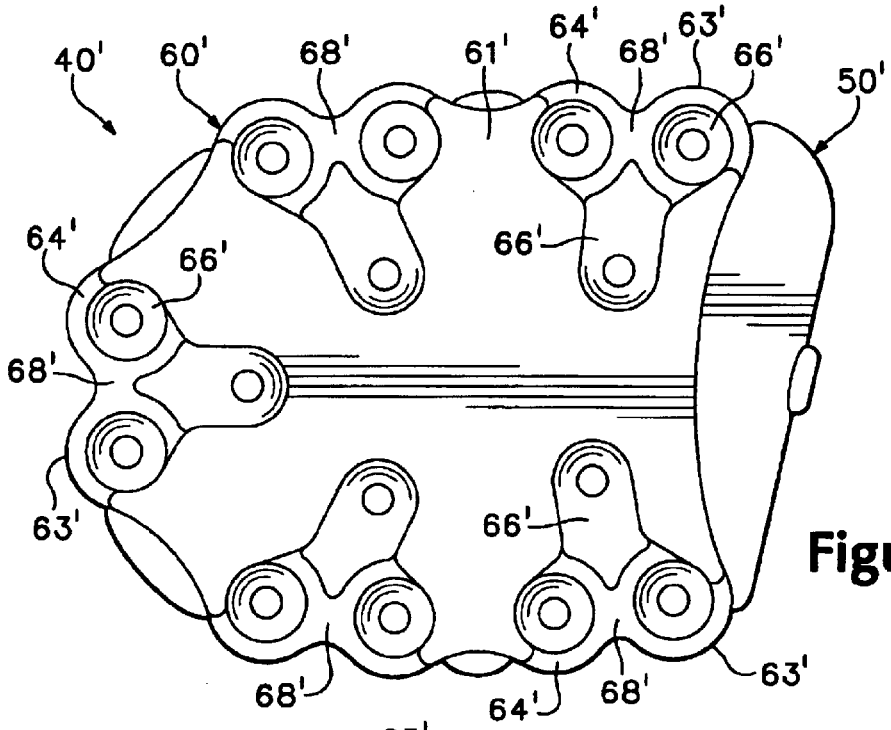
FIG. 14 is a top plan view of the cushioning component depicted in FIG. 13.
Figure 15:
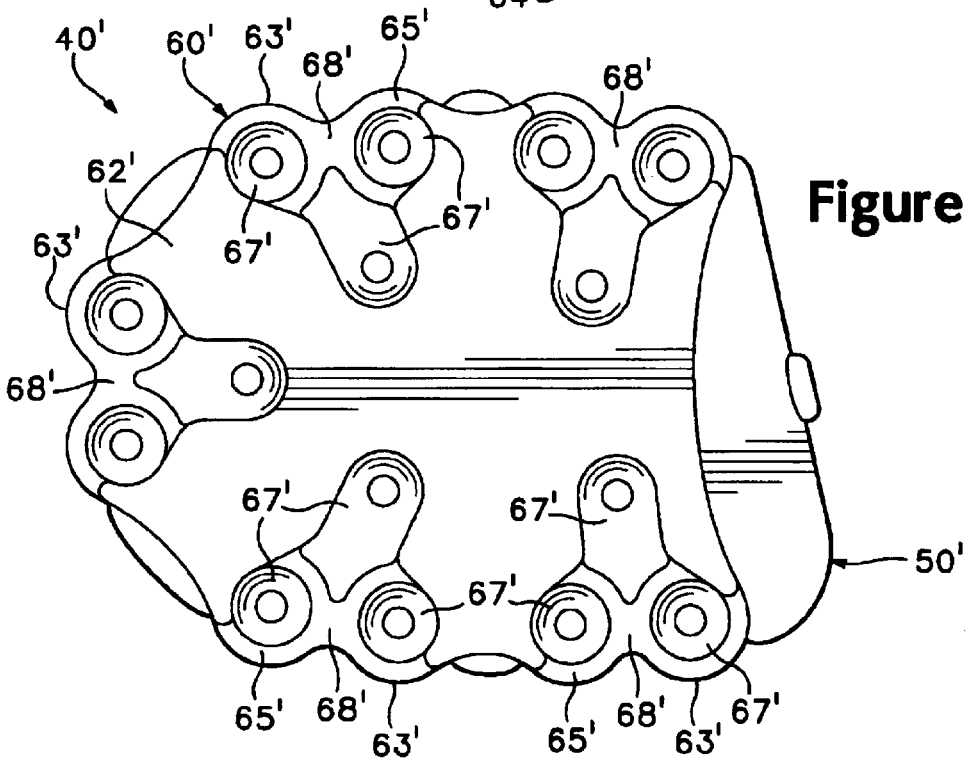
FIG. 15 is a bottom plan view of the cushioning component depicted in FIG. 13.

Another embodiment of the present invention is depicted in FIGS. 13–15 as a cushioning component 40', which includes a chamber 50' and a covering element 60'. Chamber 50' has the general configuration of chamber 50. Similarly, covering element 60' has the general configuration of covering element 60. Accordingly, covering element 60' includes a first layer 61' and a second layer 62' that are connected by inserts 63'. First layer 61' has a plurality of first portions 64', and second layer 62' has a plurality of second portions 65' In contrast with covering element 60, however, inserts 63' have a reinforced structure. More particularly, indentations 66' and 67' have a thicker, more-substantial construction, and each of indentations 66' and 67' have interior walls 68'. Interior walls 68' have a Y-shaped structure and operates to decrease the compressibility of each insert 63' due to the effects of hoop stress. As inserts 63' are positioned on peripheral portions of component 40, the decreased compressibility correspondingly increases the stiffness of the peripheral portions. One skilled in the relevant art will recognize that many modifications may be made to inserts 63 and inserts 63' to modify the overall compressibility of component 40.

Due to the substantially ambient fluid pressure, component 40 produces a relatively large deflection for a given load during initial stages of compression when compared to some of the fluid-filled chambers discussed in the Background of the Invention section. As component 40 is compressed, component 40 provides force attenuation and energy absorption, otherwise referred to as cushioning. As the compression of component 40 increases, however, the stiffness of component 40 increases in a corresponding manner due to the structure of component 40 and the manner in which component 40 is incorporated into midsole 31. Three phenomena operate simultaneously to produce the effect described above and include pressure ramping, the properties of inserts 63, and film tensioning. Each of these phenomena will be described in greater detail below.

Pressure ramping is the increase in pressure within chamber 50 that occurs as a result of compressing chamber 50. In effect, chamber 50 has an initial pressure and initial volume when not being compressed within midsole 31. As midsole 31 is compressed, however, the effective volume of chamber 50 decreases, thereby increasing the pressure of the fluid within chamber 50. The increase in pressure operates to provide a portion of the cushioning response of component 40. Accordingly, the volume of chamber 50 may be controlled through the design of chamber 50, thereby controlling the pressure ramping effect in component 40.

The properties of inserts 63 also affect the cushioning response of midsole 31. As described above, inserts 63 may be modified to have a thicker, more-substantial construction, as with inserts 63'. This decreases the compressibility of component 40 and affects the cushioning response of midsole 31. Furthermore, interior walls 68' may be formed to further decrease the compressibility of component 40. In further embodiments, inserts 63 may be a solid structure that does not include indentations 66 or indentations 67. The compressibility of component 40 may also be modified by varying the material that is utilized to form covering element 60. A change in the number of lobes **56*a*–56*f* may be utilized, for example, to decrease or increase the number of inserts 63. Accordingly, the geometry and materials utilized for inserts 63, the number of inserts 63, and the corresponding geometry of chamber 50** may be modified to have an effect upon the cushioning response.

The concept of film tensioning also has an effect upon the cushioning response of component 40. This effect is best understood when compared to pressurized prior art chambers. In the prior art chambers, the pressure within the chambers places the outer layers in tension. As the prior art chambers are compressed, however, the tension in the outer layers is relieved or lessened. Accordingly, compression of the prior art chambers operates to lessen the tension in the outer layers. In contrast with the pressurized prior art chambers, the tension in first surface 51 increases in response to compression due to bending of first surface 51. This increase in tension contributes to the cushioning response discussed above. Furthermore, bending in first layer 61 also increases the tension in first layer 61, which also contributes to the cushioning response discussed above.

Pressure ramping, the properties of inserts 63, and film tensioning operate together to attenuate forces and absorb energy. The specific effect that pressure ramping, the properties of inserts 63, and film tensioning have upon the cushioning response varies based upon location with respect to component 40. At perimeter portions of chamber 40, which corresponds with the locations of inserts 63, the properties of inserts 63 may be utilized to provide reduced compliance and, therefore, increases the corresponding stiffness. As the location tends toward central area 55, the dominant phenomena that attenuate forces and absorb energy are film tensioning and pressure ramping. One skilled in the relevant art will recognize, based upon the preceding discussion, that the specialized cushioning response of sole structure 30 is primarily related, therefore, to the configuration of component 40. More particularly, the specialized cushioning response of midsole 31 is dependent upon the structure of chamber 50 and covering element 60, including the structure of inserts 63.

Based upon the considerations of pressure ramping, the properties of inserts **63*a*–63*e*, and film tensioning, the cushioning response of midsole 31 is modifiable to provide a desired degree of force attenuation and energy absorption. For example, the volume of chamber 50, the number and shape of lobes 56*a*–56*f*, the specific configuration of inserts 63*a*–63*e*, the thickness and materials that form surfaces 51 and 52, the thickness and materials utilized to form covering element 60, and the position and orientation of component 40 within midsole 31 may be varied to modify the cushioning response. In addition, the properties of inserts 63, including wall thickness and material, may also be adjusted to modify the cushioning response. For example, the compressibility of inserts 63*a*–63*e* may be selected to be greater than the compressibility of chamber 50 for an initial degree of compression of midsole 31. By varying these and other parameters, therefore, midsole 31** may be custom tailored to a specific individual or to provide a specific cushioning response during compression.

The above discussion provides examples of components within the scope of the present invention and the manner in which the components are incorporated into footwear. As an alternative to the structure discussed above, a significant portion of sole structure 30 may be replaced by component 40. That is, component 40 may be configured to extend throughout the longitudinal length of footwear 10, and covering element 60 may have the configuration of outsole 32. In this manner, component 40 may be utilized to replace a conventional midsole and outsole structure. Furthermore, first layer 61 and second layer 62 are depicted in the figures as having a continuous, sheet-style configuration. Alternately, first layer 61 and second layer 62 may have the configuration of a web that is formed of a plurality of interconnected segments, or first layer 61 and second layer 62 may define a plurality of apertures, for example. Furthermore, first layer 61 and second layer 62 may be entirely absent in some embodiments such that covering element 60 includes only inserts 63.

As a further example of variations in component 40, inserts 63 are depicted as extending between each of the adjacent lobes 56*a*–56*f*, but may be absent between some lobes 56*a*–56*f* in order to increase compressibility in those areas. Each of inserts 63 may also be formed to have a different structure in order to tune the compressive response of component 40. In a running shoe, for example, the inserts 63 positioned in a rear, lateral corner of footwear 10 may be structured to exhibit greater compressibility than other inserts 63 to impart greater compressibility to the area of footwear 10 that initially contacts the ground during the running cycle. The inserts 63 in a basketball shoe, however, may each have a substantially similar structure to provide uniform compressibility, and thereby impart stability.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

That which is claimed is:

1. An article of footwear having an upper and a sole structure, the sole structure including a cushioning component comprising:

a chamber having a first surface and an opposite second surface peripherally joined to form a volume for receiving a fluid, the first surface and the second surface being devoid of internal connections that secure interior portions of the first surface to interior portions of the second surface, the first surface and the second surface defining a plurality of lobes extending outward from a central area of the chamber, the lobes being in fluid communication with the central area, and the lobes defining spaces positioned between the lobes located adjacent to each other; and insert positioned within the spaces, the inserts being formed of a resilient material.

2. The article of footwear recited in claim 1, wherein a pressure of the fluid is in a range of zero to five pounds per square inch.

3. The article of footwear recited in claim 1, wherein a pressure of the fluid is approximately equal to an ambient pressure of air surrounding the sole structure.

4. The article of footwear recited in claim 1, wherein the fluid is air.

5. The article of footwear recited in claim 1, wherein a first layer of polymer material extends over at least a portion of the first surface and is secured to the inserts.

6. The article of footwear recited in claim 5, wherein a second layer of the polymer material extends over at least a portion of the second surface and is secured to the inserts.

7. The article of footwear recited in claim 6, wherein the first layer and the second layer are formed integral with the inserts.

8. The article of footwear recited in claim 1, wherein layers of material extend over the first surface and the second surface,the inserts being secured to the layers of material and extending between the layers of material.

9. The article of footwear recited in claim 1, wherein the inserts are positioned adjacent a sidewall of the chamber, the sidewall extending between the first surface and the second surface.

10. The article of footwear recited in claim 1, wherein each insert includes a first portion positioned adjacent the first surface and a second portion positioned adjacent the second surface.

11. The article of footwear recited in claim 10, wherein the first portion is secured to the second portion.

12. The article of footwear recited in claim 10, wherein the first portion is formed of three concave structures, and the second portion is formed of three concave structures.

13. The article of footwear recited in claim 1, wherein central areas of the first surface and the second surface have a substantially planar configuration.

14. The article of footwear recited in claim 1, wherein the chamber includes at least five of the lobes.

15. The article of recited in claim 1, wherein at least a portion of the inserts are bonded to the chamber.

16. The article of footwear recited in claim 1, wherein the inserts are less compressible than the chamber.

17. An article of footwear having an upper and a sole structure, the sole structure including a cushioning component comprising:

a chamber enclosing a fluid having a pressure approximately equal to an ambient pressure of air surrounding the cushioning component, the chamber having a first surface and an opposite second surface peripherally joined to form a volume for receiving the fluid, the first surface and the second surface being devoid of internal connections that secure interior portions of the first surface to interior portions of the second surface, the first surface and the second surface defining a plurality of lobes extending outward from a central area of the chamber, the lobes being in fluid communication with the central area, and the lobes defining spaces positioned between the lobes located adjacent to each other; and a covering element having a first layer, a second layer, and a plurality of inserts extending between the first layer and the second layer, the first layer extending over at least a portion of the first surface, the second layer extending over at least a portion of the second surface, and the Inserts being positioned within the spaces.

18. The article of footwear recited in claim 17, wherein the fluid is air.

19. The article of footwear recited in claim 17, wherein the inserts are less compressible than the chamber.

20. The article of footwear recited in claim 17, wherein each insert includes a first portion positioned adjacent the first surface and a second portion positioned adjacent the second surface.

21. The article of footwear recited in claim 20, wherein the first portion is secured to the second portion.

22. The article of footwear recited in claim 20, wherein the first portion is formed of three concave structures, and the second portion is formed of three concave structures.

23. The article of footwear recited in claim 17, wherein central areas of the fret surface and the second surface have a substantially planar configuration.

24. The article of footwear recited in claim 17, wherein the chamber includes at least five of the lobes.

25. The article of footwear recited in claim 17, wherein the inserts are positioned adjacent a sidewall of the chamber, the sidewall extending between the first surface and the second surface.

26. The article of footwear recited in claim 17, wherein at least a portion of the inserts are bonded to the chamber.

27. An article of footwear having an upper and a sole structure, the sole structure including a cushioning component comprising:

a chamber having a first surface and an opposite second surface peripherally joined to form a volume for receiving a fluid, the first surface and the second surface being devoid of internal connections that secure interior portions of the first surface to interior portions of the second surface, the first surface and the second surface defining a plurality of lobes extending outward from a central area of the chamber, the lobes being in fluid communication with the central area, and the lobes defining spaces positioned between the lobes located adjacent to each other; and a covering element having a first layer, a second layer, and a plurality of inserts extending between the first layer and the second layer, the first layer extending over the first surface, the second layer extending over the second surface, and the inserts being positioned within the spaces, each insert having a first portion and a second portion, the first portion being located adjacent the first surface and the second portion being located adjacent the second surface, and the first portion being joined with the second portion to secure the covering element to the chamber, the inserts having a configuration that is less compressible than the chamber.

28. The article of footwear recited in claim 27, wherein a pressure of the fluid is in a range of zero to five pounds per square inch.

29. The article of footwear recited in claim 27, wherein a pressure of the fluid is approximately equal to an ambient pressure of air surrounding the sole structure.

30. The article of footwear recited in claim 27, wherein the fluid is air.

31. The article of footwear recited in claim 27, wherein the first portion is formed of three concave structures, and the second portion is formed of three concave structures.

32. The article of footwear recited in claim 27, wherein central areas of the first surface and the second surface have a substantially planar configuration.

33. An article of footwear comprising:

an upper for receiving a foot of a wearer; and a sole structure secured to the upper, the sole structure including:

a midsole formed of a polymer foam material, and a cushioning component at least partially encapsulated by the foam material of the midsole, the cushioning component having a chamber and a plurality of insert, the chamber enclosing a fluid having a pressure approximately equal to an ambient pressure of air surrounding the cushioning component, and the chamber having a first surface and an opposite second surface peripherally joined to form a volume for receiving the fluid, the first surface and the second surface being devoid of internal connections that secure interior portions of the first surface to interior portions of the second surface, the first surface and the second surface defining a plurality of lobes extending outward from a central area of the chamber, the lobes being in fluid communication with the central area, and the lobes defining spaces positioned between the lobes located adjacent to each other, the inserts being positioned within the spaces, and the inserts being less compressible than the chamber.

34. The article of footwear recited in claim 33, wherein the cushioning component is positioned within a heel portion of the midsole.

35. The article of footwear recited in claim 33, wherein an edge of the cushioning component protrude through an edge of the midsole.

36. The article of footwear recited in claim 33, wherein an upper surface of the cushioning component is coextensive with an upper surface of the midsole.

37. The article of footwear recited in claim 33, wherein the fluid is air.

38. The article of footwear recited in claim 33, wherein a first layer extends over at least a portion of the first surface and is secured to the inserts.

39. The article of footwear recited in claim 38, wherein a second layer extends over at least a portion of the second surface and is secured to the inserts.

40. The article of footwear recited in claim 33, wherein layers of material extend over the first surface and the second surface, the inserts being secured to the layers of material and extending between the layers of material.

41. The article of footwear recited in claim 33, wherein each insert includes a first portion positioned adjacent the first surface and a second portion positioned adjacent the second surface.

42. The article of footwear recited in claim 41, wherein the first portion is secured to the second portion.

43. The article of footwear recited in claim 41, wherein the first portion is formed of three concave structures, and the second portion is formed of three concave structures.

44. The article of footwear recited in claim 33, wherein central areas of the first surface and the second surface have a substantially planar configuration.

45. The article of footwear recited in claim 33, wherein the chamber includes at least five of the lobes.

46. An article of footwear having an upper and a sole structure secured to the upper, the sole structure comprising:

a midsole formed of a polymer foam material, a cushioning component at least partially encapsulated by the foam material of the midsole, the cushioning component having:

a chamber enclosing a fluid having a pressure approximately equal to an ambient pressure of air surrounding the cushioning component, and the chamber having a first surface and an opposite second surface peripherally joined to form a volume for receiving the fluid, the first surface and the second surface being devoid of internal connections that secure interior portions of the first surface to interior portions of the second surface, the first surface and the second surface defining a plurality of lobes extending outward from a central area of the chamber, the lobes being in fluid communication with the central area, and the lobes defining spaces positioned between the lobes located adjacent to each other a covering element having a first layer, a second layer, and a plurality of inserts extending between the first layer and the second layer, the first layer extending over the first surface, the second layer extending over the second surface, and the inserts being positioned within the spaces, the inserts each having a first portion and a second portion, the first portion being located adjacent the first surface and the second portion being located adjacent the second surface, and the first portion being joined with the second portion to secure the covering element to the chamber, the inserts having a configuration that is less compressible than the chamber an outsole secured to the midsole.

47. The article of footwear recited in claim 46, wherein an edge of the cushioning component protrude through an edge of the midsole.

48. The article of footwear recited in claim 46, wherein an upper surface of the cushioning component is coextensive with an upper surface of the midsole.

49. The article of footwear recited in claim 46, wherein the fluid is air.

50. The article of footwear recited in claim 46, wherein the first portion is formed of three concave structures, and the second portion is formed of three concave structures.

* * * * *